United States Patent [19]

Beard

[11] Patent Number: 4,671,481

[45] Date of Patent: Jun. 9, 1987

[54] ANTIDISLODGEMENT CLIPS

[75] Inventor: Michael D. Beard, Hudsonville, Mich.

[73] Assignee: Herman Miller, Inc., Zeeland, Mich.

[21] Appl. No.: 787,636

[22] Filed: Oct. 15, 1985

[51] Int. Cl.[4] ..... F16L 3/08

[52] U.S. Cl. ..... 248/222.1; 108/153; 248/222.2; 248/243; 312/263

[58] Field of Search ..... 248/222.1, 220.2, 222.2, 248/225.2, 227, 246, 245, 243, 239; 211/189, 192; 108/153; 312/263, 264; 52/36

[56] References Cited

U.S. PATENT DOCUMENTS

| | | | |
|---|---|---|---|
| 2,261,956 | 11/1941 | Brownlie et al. | 248/243 |
| 2,980,037 | 4/1961 | Elsner | 248/222.1 |
| 3,144,945 | 8/1964 | Seiz | 211/176 |
| 3,392,848 | 7/1968 | McConnell et al. | 211/192 |
| 3,601,432 | 8/1971 | Fenwick | 211/192 X |
| 3,730,108 | 5/1973 | Stroh | 108/108 |
| 3,966,158 | 6/1976 | Boundy | 248/243 |
| 4,042,201 | 8/1977 | O'Callaghan | 211/192 X |
| 4,048,768 | 9/1977 | Good | 52/36 |
| 4,094,485 | 6/1978 | O'Callaghan | 211/192 X |
| 4,103,856 | 8/1978 | Riblet | 248/246 |
| 4,106,738 | 8/1978 | Kostecky | 248/243 X |
| 4,126,906 | 11/1978 | Foust | 312/263 X |
| 4,205,815 | 6/1980 | Sauer et al. | 248/243 |
| 4,270,821 | 6/1981 | Verdesca | 248/225.2 X |
| 4,421,289 | 12/1983 | Sturm | 248/246 |
| 4,534,529 | 8/1985 | Dorner | 248/222.1 |

*Primary Examiner*—Ramon O. Ramirez

*Attorney, Agent, or Firm*—Varnum, Riddering, Schmidt & Howlett

[57] ABSTRACT

A first antidislodgement clip (10) and a second antidislodgement clip (12) cooperate to lock a bracket (16), supporting a work surface (14), to a vertical slotted standard (18) and are automatically set in locked positions when the work surface (14) is mounted to the standard (18). The bracket (16) has a pair of support bosses (38). A hanger plate (20) has a number of fingers (56), a plurality of hooks (48) and a series of tabs (52). The lowermost finger (56) has a detent notch (66). The first antidislodgement clip (10) is pivotably mounted to the hanger plate (20), and the second antidislodgement clip (12) is pivotably mounted to the bracket (16). Lockably securing the work surface (14) to the standard (18) requires first mounting the hanger plate (20) to the standard (18) by engaging the hooks (48) and the tabs (52) with the slots (22) of the standard (18). The bracket (16) is then partially mounted onto the hanger plate (20) such that the fingers (56) partially engage the bosses (38). At this time, the support bracket (16) is in contact with the first antidislodgement clip (10) and the lowermost finger (56) of the hanger plate (20) is in engagement with the second antidislodgement clip (12). Further engagement of the support bracket (16) onto the hanger plate (20) causes the first antidislodgement clip (10) to move to locked position in a slot (22) above a tab (52) of the hanger plate (20) and the second antidislodgement clip (12) to lock underneath the detent notch (66) of the lowermost finger (56). In this manner, the first antidislodgement clip (10) prevents upward vertical movement of the hooks (48) with respect to the slots (22) and thus inadvertent dislodgement of the hanger plate (20) from the vertical standard (18). In addition, the support bracket (16) is firmly secured to the hanger plate (20) by the second antidislodgement clip (12) which rests underneath the detent notch (66) to prevent dislodgement of the support bosses (38) from the fingers (56).

18 Claims, 7 Drawing Figures

ANTIDISLODGEMENT CLIPS

FIELD OF THE INVENTION

This invention relates to mounting a piece of furniture to a supporting structure and more particularly to removably securing a work surface to a vertical slotted standard rigidly secured to the supporting structure.

BACKGROUND OF THE INVENTION

In modern office designs it is desirable to have furniture, such as work surfaces, shelves, cabinets and the like, removably mounted to the interior walls of a building and/or the freestanding walls the so-called "open plan" office system. To this end, the furniture elements, or supporting brackets to which the same are attached, are provided, on the rear portions thereof, with hooks or tabs adapted to engage vertical slotted standards rigidly secured to the interior or freestanding walls. In order to circumvent damage to the furniture or injuries to workers which may result from inadvertent disengagement of the hooks or tabs from the vertical standards, it is desirable to provide a device capable of locking the hooks or tabs in engagement with the slots of the standard. Utilization of a device which requires, during assembly of the furniture to the vertical standard, a conscious manual step on the part of the individual conducting such installation may result in disengagement of the furniture and thus damage and injury in that such individual, due to temporary memory loss, may not dispose the device in locked condition. To eliminate the possibility of human error and insure that the locking device is always set in the locked condition when the furniture is mounted to the wall, it is desirable to employ a locking device which is automatically set in locked condition upon the installation of the furniture to the vertical slotted standard but yet which can be unlocked to remove the furniture piece from the standard.

Devices for securely locking furniture and other appurtenances to supporting structures are known. These devices, however, are not automatically disposed in locked condition when the furniture is mounted to the support structures. Rather, to set the devices in locked condition, the individual installing the furniture must, subsequent to mounting the furniture to the supporting structure, perform some manual operation.

For example, the U.S. Pat. No. 4,048,768 to Good, issued Sept. 20, 1977, discloses a device for locking the hooks of an appurtenance to the slots of a vertical standard. A bracket is rigidly attached to the appurtenance and has downwardly depending tabs for engaging the slots of the standard. The locking device comprises a hook pivotably attached to the bracket and adapted to be removably received within a slot of the vertical standard. The appurtenance is locked to the vertical standard by first inserting the tabs of the bracket into the slots of the standard and subsequently forcibly inserting the hook into an adjacent slot above the slot housing the uppermost tab of the bracket.

The Fenwick et al U.S. Pat. No. 3,601,432, issued Aug. 24, 1971, discloses a frame structure for a department store display fixture comprising vertical and horizontal members and a locking device for rigidly securing the vertical members to the horizontal members. The vertical members have a number of vertically disposed slots. Rigidly secured to opposite ends of each horizontal member is a brace from which protrude two hooks vertically spaced so as to be registrable with the slots in the vertical member. The locking device comprises a bar pivotably mounted to the brace and having a horizontal tab which rests directly above the lowermost hook of the brace and a flange to facilitate actuation of the bar. When the hooks are inserted into the slots of the vertical member, there remain spaces in the slots above the hooks, the bottom space to be filled with the horizontal tab of the locking device. The insertion of the tab is accomplished by subsequently applying force to the flange so as to cause pivoting of the bar to the locked position.

Finally, the patent to Stroh 3,730,108, issued May 1, 1973, discloses a shelf support structure including a vertical slotted standard, a wire shelf and a mechanism for locking the shelf to the standard. The mechanism comprises a bracket rigidly secured to the shelf and having a number of downwardly-depending hooks received within the slots of the standard and a device pivotably mounted to the bracket and adapted to engage an unoccupied slot of the standard to prevent upward vertical movement of the shelf and thus inadvertent dislodgement of the hooks from the standard. Like the locking devices in Good and Fenwick et al, the locking device in Stroh is manually set in the locked condition after the appurtenance is mounted to the slotted standard.

SUMMARY OF THE INVENTION

According to the invention, there is provided a mounting assembly for removably locking a piece of furniture to a wall having attached thereto a vertical standard with a plurality of slots. The mounting assembly includes a hanger bracket having a first mounting means adapted to removably engage the slots in the standard to thereby removably mount the hanger bracket to the standard. A second mounting means is provided on the hanger bracket for supporting a support bracket. A hanger clip is mounted to the hanger bracket for movement between locked and unlocked positions. The hanger clip is adapted to engage at least one slot of the standard when in the locked position to lock the hanger bracket thereto and is further adapted to be free from engagement with the standard when in the unlocked position to allow the hanger bracket to be freely removed from the standard. A support bracket is rigidly secured to the furniture piece and has a mounting means adapted to engage the hanger bracket second mounting means to removably mount the support bracket to the hanger bracket. A support clip is movably mounted to the support bracket for movement between locked and unlocked positions. The support clip is adapted to engage the hanger bracket second mounting means in the locked position when the support bracket is mounted to the hanger bracket to lock the support bracket to the hanger bracket and is adapted to be free from engagement with the hanger bracket in the unlocked position to allow the support bracket to be freely removed from the hanger bracket. A hanger clip actuating means on the support bracket is adapted to engage the hanger clip to force the hanger clip into the locked position when the support bracket is mounted to the hanger bracket. A support clip actuating means on the hanger bracket is adapted to force clip into the locked position as the support bracket is mounted to the hanger bracket.

The invention provides for at least one of the hanger clip and support clip to be automatically set in locked position when the hanger bracket is mounted to the standard and the support bracket is mounted to the hanger bracket.

Preferably, the first mounting means of the hanger bracket comprises at least one hook and at least one tab. The hook and the tab are both adapted to removably engage a corresponding number of slots in the standard. The hanger clip actuating means comprises a rear wall of the support bracket and is adapted to force the hanger clip into one of the slots adjacent to either the hook or the tab to lockably secure the hook and tab within the slots when the hanger bracket is mounted to the standard and the support bracket is mounted to the hanger bracket.

Further, the support bracket mounting means preferably comprises at least one support boss and the support actuating means comprises at least one finger adapted to supportingly engage the support boss and to engage the support clip to lockably secure the support boss on the finger when the support bracket is mounted to the hanger bracket. The support bracket desirably comprises spaced side walls which define a channel with a slot at the rear edge thereof and a hole extending through one of the side walls. The support boss is positioned in the channel. The finger has an upwardly-opening indentation in which the support boss rests when the support bracket is mounted to the hanger bracket and means are provided to guide the finger into a position of engagement with the support boss and in the channel.

The support clip preferably has a locking flange extending through the hole and into the channel. The finger is adapted to engage the locking flange to lockably secure the support boss to the finger when the support bracket is mounted to the hanger bracket. Desirably, the locking flange is positioned at an acute angle to the side walls.

BRIEF DESCRIPTION OF THE DRAWINGS

The invention will now be described with reference to the drawings in which.

DESCRIPTION OF THE PREFERRED EMBODIMENTS

Figure 1:
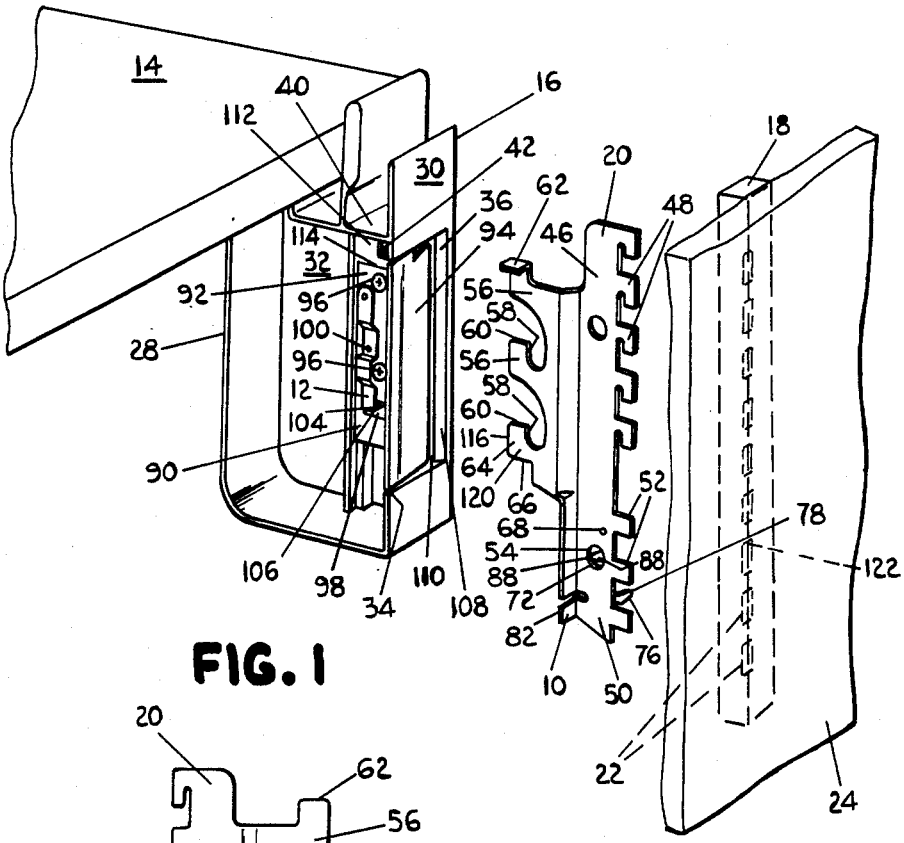
FIG. 1 is an exploded perspective view of the antidislodgement clip assembly of the invention.
Figure 6:
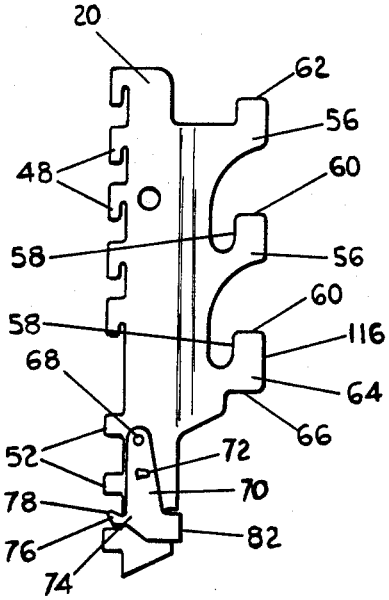
FIG. 6 is a side view of the hanger plate and the first antidislodgement clip.

Referring to the drawings, there is shown a first antidislodgement clip 10 and a second antidislodgement clip 12, both of which cooperate to lockably secure a piece of furniture, such as a work surface 14, and its associated support bracket 16, to a vertical slotted standard 18 through a hanger plate 20 which is removably secured to the support bracket. The first and second clips are designed so that they are automatically set in locked positions when the work surface is mounted to the vertical standard but yet are removable from the standard as desired to change the location of the work surface.

The vertical standard 18 has a plurality of vertically spaced slots 22 and is of the type typically mounted to the interior wall of a building or to a freestanding wall of a modern modular office system of the so-called "open-plan" type, the interior wall or freestanding wall being represented by reference number 24. The support bracket 16 comprises a horizontally disposed work surface support leg 26, a vertical leg 28, a rear edge 30, an inside wall 32 and a longitudinal axis coextensive with the longitudinal axis of the horizontal leg 26. The rear edge 30 of the support bracket 16 has therethrough a central opening 34 and an angular surface 36 leading into the opening. The bracket 16 also includes a pair of vertically spaced support bosses 38 rigidly secured to or integral with the inside wall 32 of the bracket, an upper wall 40 and a first flange 42 extending downwardly from the upper wall and rearwardly to the rear edge 30 and to the upper portion 44 of the opening 34.

The hanger plate 20 comprises, on the upper portion 46 thereof, a series of downwardly-projecting hooks 48 and, on the lower portion 50 thereof, a plurality of rearwardly-extending tabs 52, with the hooks and the tabs adapted to engage a corresponding number of selected slots 22 of the vertical standard 18. In addition, the hanger plate has extending through the lower portion 50 thereof a hole 54. Also, the hanger plate 20 includes a number of forwardly-and upwardly-extending fingers 56, with the two lowermost fingers 56 having indentations 58 in the top parts 60 thereof, the uppermost finger 56 having an inwardly-projecting flag 62 at the top part 60 thereof and the lowermost finger 56 having at the bottom part 64 thereof a detent notch 66.

The first antidislodgement clip 10 is pivotably mounted to and in matting engagement with the lower portion 50 of the hanger plate 20, with a pin 68 providing the pivotal connection between the first antidislodgement clip and the hanger plate. The first antidislodgement clip 10 comprises, at a central portion 70 thereof, a second flange 72 engaging the hole 54 in the hanger plate 20; and, at the rear end 74 thereof, a rearwardly-projecting first lock 76 adapted to be received within a slot 22 of the standard 18 above a tab 52 of the hanger plate 20 and having an upper camming surface 78. In addition, the first antidislodgement clip 10 has, at the forward end 80 thereof, a tongue 82 positioned substantially at a right angle to the body 84 of the first antidislodgement 10 and adapted to engage a forward edge 86 of the hanger plate 20 and the rear edge 30 of the support bracket 16 when the first lock 76 is set in the locked position.

In the preferred embodiment, the second flange 72 is formed integral with the body 84 of the first antidislodgement clip 10 by stamping a portion of the body and subsequently bending the stamped portion thereof a sufficient amount so as to enable the stamped portion to engage the hole 54 in the hanger plate 20. It is contemplated, however, that the second flange 72 and the body 84 can be separate elements, in which case the former is secured to the latter by welding or any other suitable connecting means. Also, in the preferred embodiment, the hole 54 in the hanger plate 20 is of a circular configuration, although holes with other suitable geometric shapes may be employed.

The second flange 72 limits pivotal movement of the first antidislodgement clip 10 a distance substantially equal to the horizontal width of the hole 54 in the hanger plate 20 due to interference of the second flange with the edges 88 of the hole 54. Such distance is great enough to allow the first lock 76 to pivot to either a fully locked position or to a fully unlocked position. The tongue 82 facilitates pivotal movement of the first antidislodgement clip 10 to the locked position in that the support bracket 16 exerts a rearward force on the tongue when the bracket is mounted to the hanger plate. In addition, the tongue 82 aids in restricting rearward pivotal movement of the first antidislodgement clip 10 by engaging the forward edge 86 of the hanger plate 20 when the first antidislodgement clip pivots to the locked position.

In cooperation with the first antidislodgement clip 10 is a second antidislodgement clip 12 mounted to the support-bracket 16. A V-shaped guide plate 90 is connected to the inside wall 32 of the support bracket 16 and has two legs positioned substantially at a right angle to one another. A first leg 92 of the guide plate 90 is positioned along the longitudinal axis of the support bracket 16, while a second leg 94 lies perpendicular to that axis, along the rear edge 30 of the support bracket and in the opening 34 in the rear edge 30 of the support bracket. The guide plate 90 is rigidly secured to the support bracket 16 by, in the preferred embodiment, a pair of screws 96 which extend through the first leg 92 and into threaded bores 97 in the support bosses 38. It is contemplated, however, that the guide plate may be secured to the support bracket by any other suitable means, such as by welding. The first leg 92 has extending therethrough an aperture 98. The second antidislodgement clip 12 is an elongated resilient member pivotably mounted to the first leg 92 of the guide plate 90 by a stud 100 and has, on the bottom part 102 thereof, an outwardly directed second lock 104. The second lock 104 engages the aperture 98 and has a radial cam 106.

The second leg 94 of the guide plate 90 and the angular surface 36 of the rear edge 30 of the support bracket 16 form a V-shaped groove 108 at the bottom of which is a vertical slot 110 formed between the first leg 92 of the guide plate and the inside wall 32 of the support bracket. In addition, a forwardly-and upwardly-extending channel 112 is defined by upper edge 114 of the first leg 92 and the upper wall 40 and the first flange 42 of the support bracket 16. Further, the support bosses 38, as indicated previously, are positioned in the vertical slot 110.

Figure 2:
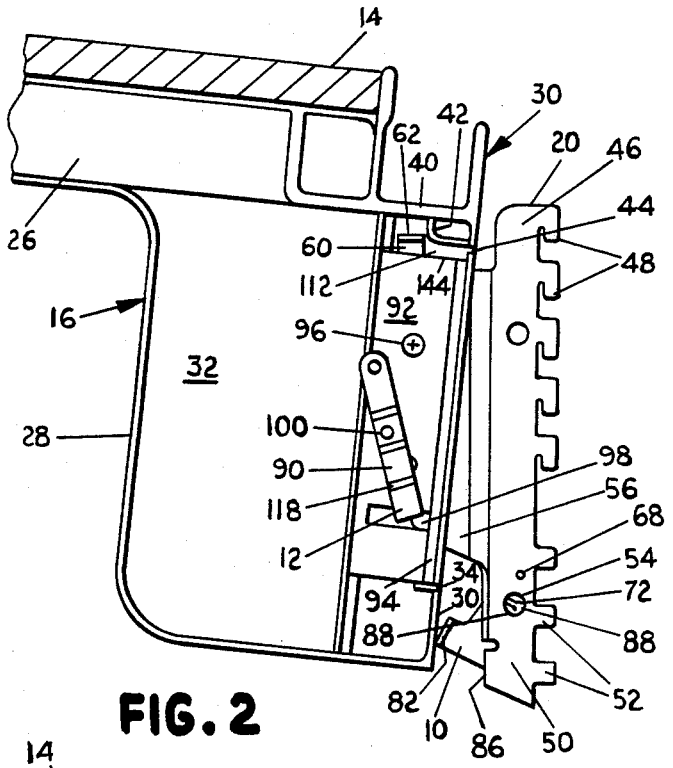
FIG. 2 is a sideview thereof, showing the support bracket being mounted to the hanger plate.
Figure 3:
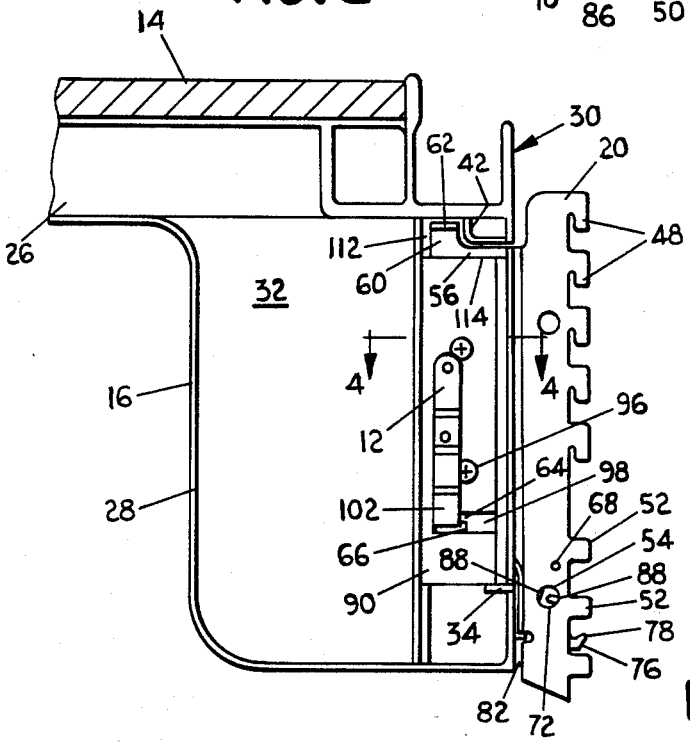
FIG. 3 is a side view like FIG. 2, showing the support bracket fully mounted to the hanger plate.
Figure 4:
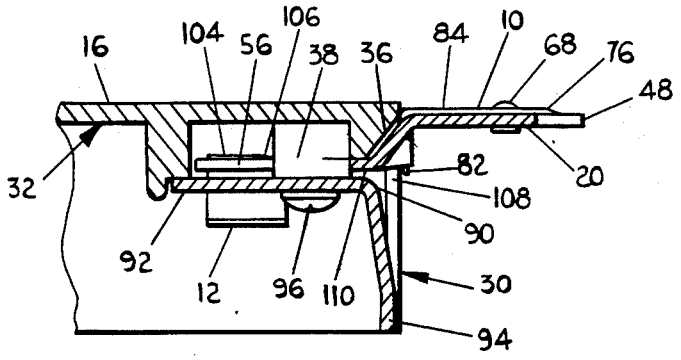
FIG. 4 is a cross-sectional view taken along lines 4—4 of FIG. 3.

Installation of the hanger plate 20 onto the vertical standard 18 and engagement of the support bracket 16 with the hanger plate 20 are as follows. First, the hanger plate is secured to the vertical standard by positioning the hooks 48 and the tabs 52 of the hanger plate within selected slots 22 of the standard. The support bracket 16 is then partially positioned on the fingers 56 of the hanger plate 20 such that the flag 62 on the uppermost finger of the hanger plate is disposed in the channel 112 and extends inwardly over the first leg 92 of the guide plate 90 and the support bosses 38 partially engage the indentations 58 in the two lowermost fingers 56. In this manner, the flag 62 functions to guide the two bottom fingers 56 and the uppermost finger 56 into correct position with respect to the support bosses 38 and the channel 112, respectively. At this time, as shown in FIG. 2, the rear edge 30 of the support bracket 16 is in contact with the tongue 82 of the first antidislodgement clip 10 and the leading edge 116 of the lowermost finger of the hanger plate is in engagement with the second lock 104 of the second antidislodgement clip 12. Further rotation of the support bracket 16 onto the hanger plate 20 causes (1) the first antidislodgement clip 10 to rotate in a counterclockwise direction (as viewed in FIG. 2) until the first lock 76 reaches the fully locked position in the slot 22 above the lowermost tab 52 of the hanger plate and (2) the second antidislodgement clip 12 to rotate in a clockwise direction (as viewed in FIG. 2) until the second lock 104 engages the front edge 118 of the aperture 98 in the guide plate 90, at which time the second lock, with its radial cam 106, cams over the leading edge 116 and the inner face 120 of the lowermost finger of the hanger plate. When the support bracket 16 is fully positioned on the hanger plate 20, as shown in FIG. 3, the second lock 104 of the second antidislodgement clip 12 rests underneath the detent notch 66 of the lowermost finger, the flag 62, on the uppermost finger, rests fully within the channel 112 and the bosses 38 of the support bracket 16 are fully positioned within the indentations 58 in the two lowermost fingers of the hanger plate.

The first antidislodgement clip 10 is secured in its locked position by the camming action of the cam 78 of the first lock 76 against the upper edge 122 of the slot 22 in which the first lock is engaged and the interference of the rear edge 30 of the support bracket 16 with the tongue 82 of the first antidislodgement 10. In this manner, the first antidislodgement clip 10 prevents upward vertical movement of the hooks 48 with respect to the slots 22 and thus inadvertent dislodgement of the hanger plate 20 from the vertical standard 18. The support bracket 16 is firmly secured to the hanger plate 20 by the second lock 104 which rests underneath the detent notch 66 of the lowermost finger 56 to prevent disengagement of the support bosses 38 and the uppermost finger 56 from the indentations 58 in the two lowermost fingers 56 and the channel 112, respectively.

Figure 7:
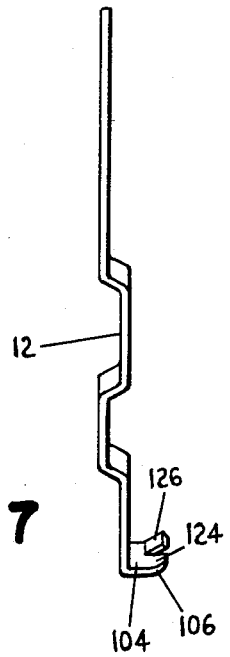
FIG. 7 is a front perspective view of the second antidislodgement clip.
Figure 5:
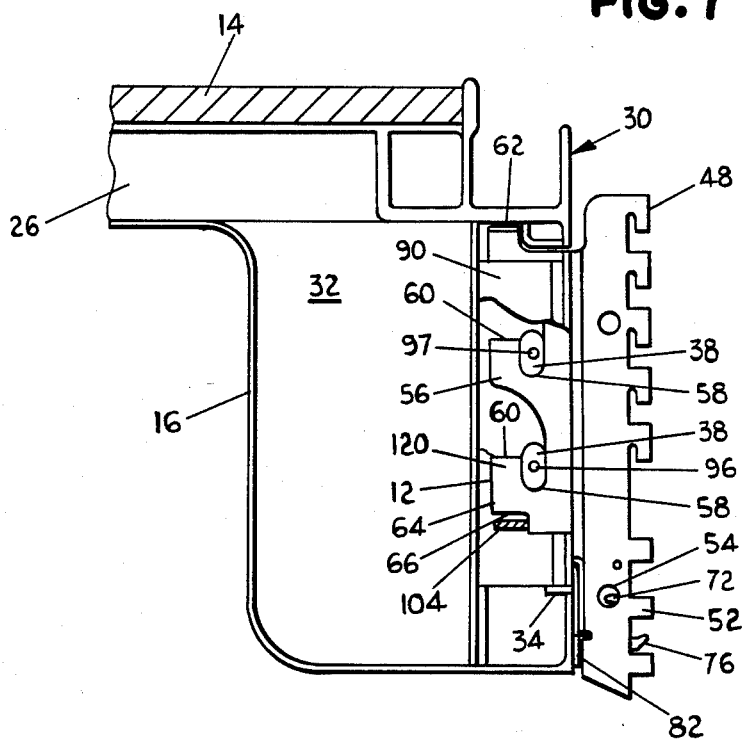
FIG. 5 is a fragmentary side view like FIG. 3, showing the support bosses of the support bracket engaging the fingers of the hanger plate.

In the preferred embodiment, as shown in FIG. 7, the second lock 104 comprises a first portion 124 positioned perpendicular to the second antidislodgement clip 12 and a second portion 126 angled upwardly with respect to the first portion, rather than consisting of one element positioned at 90° with respect to the second clip. With this preferred design, the detent notch 66 of the lower most finger 56, when the support bracket 16 is mounted to the hanger plate 20, rests on the first portion 124 of the second lock 104. In addition, in this manner, the second lock is better secured underneath the detach notch 66 and is thus better able to prevent disengagement of the bosses 38 from the indentations 58 and the flag 62, on the upper most finger 56, from the channel 112 when upwardly directed force is exerted on the work surface 14.

To remove the support bracket 16 from the hanger plate 20 and disengage the hanger plate from the vertical standard 18, the second antidislodgement clip 12 is turned in a counterclockwise direction (as viewed in FIG. 3), causing the radial cam 106 of the second lock 104 to cam over the inner face 120 of the lowermost finger 56. Since the second lock no longer interferes with the detent notch 66 of the bottom finger, the support bracket 16, specifically the support bosses 38, can be lifted out of the indentations 58 of the fingers 56. At this time, the uppermost finger 56 does not interfere with the first flange 42 of the bracket 16 and thus the support bracket 16 can be detached from the hanger plate 20 by simply pulling the support forwardly. In addition, since the rear edge 30 of the support bracket 16 no longer interferes with forward movement of the tongue 82 of the first antidislodgement clip 10, the first antidislodgement clip can be pivoted in the clockwise direction (as viewed in FIG. 3) such that the first lock 76 is no longer in engagement with its respective slot 22 in the standard 18, to thereby allow the hooks 48 of the hanger plate to be lifted upwardly and the same, along with the tabs 52, outwardly of the slots of the vertical standard.

In this manner, the first antidislodgement clip 10 and the second antidislodgement clip 12 both cooperate to lockably secure the work surface 14, and its associated support bracket 16, to the vertical slotted standard 18 through the hanger plate 20 removably secured to the support bracket, and are automatically set in locked positions when the work surface is secured to the vertical standard. Further, the antidislodgement clips can be disengaged as desired to change the location of the work surface or other supported furniture.

While the invention has been described in connection with a preferred embodiment, it will be understood that the invention is not limited to the disclosed embodiment. To the contrary, reasonable variations, alternatives, modifications and equivalents are possible within the spirit and scope of the invention as defined by the appended claims.

The embodiments of the invention in which an exclusive property or privilege is claimed are defined as follows:

1. A mounting assembly for removably locking a piece of furniture to a wall having attached thereto a vertical standard having a plurality of slots, said mounting assembly including:

a hanger bracket having a first mounting means adapted to removably engage said slots of said standard to removably mount said hanger bracket to said standard, a second mounting means for supporting a support bracket, and a hanger clip mounted to said hanger bracket for movement between locked and unlocked positions, said hanger clip adapted to engage at least one slot of said standard when in the locked position to lockably secure said hanger bracket thereto and adapted to be free from engagement with said standard when in the unlocked position to allow said hanger bracket to be freely removed from said standard;

said support bracket rigidly secured to said furniture piece and having a mounting means adapted to engage said hanger bracket second mounting means to removably mount said support bracket to said hanger bracket and having movably mounted thereto for movement between locked and unlocked positions a support clip adapted to engage said hanger bracket second mounting means in the locked position when said support bracket is mounted to said hanger bracket to lockably secure said support bracket to said hanger bracket and adapted to be free from engagement with said hanger bracket in the unlocked position to allow said support bracket to be freely removed from said hanger bracket;

a hanger clip actuating means on said support bracket and adapted to engage said hanger clip to force said hanger clip into the locked position when said support bracket is mounted to said hanger bracket; and support clip actuating means on said hanger bracket adapted to force said support clip into said locked position as said support bracket is mounted to said hanger bracket;

whereby said hanger clip and said support clip are both automatically set in locked position when said hanger bracket is mounted to said standard and said support bracket is mounted to said hanger bracket.

2. A mounting assembly according to claim 1, wherein said first mounting means of said hanger bracket comprises at least one hook and at least one tab, said hook and said tab both adapted to removably engage a corresponding number of slots in said standard;

said hanger clip actuating means comprises a rear wall of said support bracket and adapted to force said hanger clip into one of said slots adjacent to either of said hook or said tab to lockably secure said hook and said tab within said slots when said hanger bracket is mounted to said standard and said support bracket is mounted to said hanger bracket.

3. A mounting assembly according to claim 2 wherein said support bracket mounting means comprises at least one support boss; and said support clip actuating means comprises at least one finger forming a part of said second mounting means and adapted to supportingly engage said support boss and to engage said support clip to lockably secure said support boss on said finger when said support bracket is mounted to said hanger bracket.

4. A mounting assembly according to claim 3, wherein said support bracket further comprises spaced side walls which define a channel with a slot at a rear edge thereof, a hole extending through one of said side walls, said support boss being positioned in said channel;

said finger comprises an upwardly-opening indentation in which said support boss rests when said support bracket is mounted to said hanger bracket and means adapted to guide said finger into a position of engagement with said support boss and in said channel.

5. A mounting assembly according to claim 4 wherein said support clip has a locking flange extending through said hole and into said channel;

whereby said finger is adapted to engage said locking flange to lockably secure said support boss to said finger when said support bracket is mounted to said hanger bracket.

6. A mounting assembly according to claim 4, wherein a portion of said locking flange is positioned at an acute angle to said side walls.

7. A mounting assembly according to claim 4, wherein said hanger bracket further comprises an aperture having a front edge portion and a rear edge portion; and said hanger clip further comprises retaining means in registry with said aperture and adapted to engage said front edge portion and said rear edge portion to limit movement of said hanger clip a distance sufficient to enable said hanger clip to move to a fully unlocked position and a fully locked position, respectively.

8. A mounting assembly according to claim 1 wherein said support bracket mounting means comprises at least one support boss; and said support clip actuating means comprises at least one finger forming a part of said second mounting means and adapted to supportingly engage said support boss to engage said support clip to lockably secure said support boss on said finger when said support bracket is mounted to said hanger bracket.

9. A mounting assembly according to claim 8 wherein said support bracket further comprises spaced side walls which define a channel with a slot at a rear edge thereof, a hole extending through one of said side walls, said support boss being positioned in said channel;

said finger comprises an upwardly-opening indentation in which said support boss rests when said support bracket is mounted to said hanger bracket and means adapted to guide said finger into a position of engagement with said support boss and in said channel.

10. A mounting assembly according to claim 9 wherein said support clip has a locking flange extending through said hole and into said channel;

whereby said finger is adapted to engage said locking flange to lockably secure said support boss to said finger when said support bracket is mounted to said hanger bracket.

11. A mounting assembly for removably locking a piece of furniture to a wall having attached thereto a vertical standard having a plurality of slots, said mounting assembly including:

a hanger bracket having a first mounting means adapted to removably engage said slots of said standard to removably mount said hanger bracket to said standard, a second mounting means for supporting a support bracket, and a hanger clip mounted to said hanger bracket for movement between locked and unlocked positions, adapted to engage at least one slot of said standard when in the locked position to lockably secure said hanger bracket thereto and adapted to be free from engagement with said standard when in the unlocked position to allow said hanger bracket to be freely removed from said standard;

said support bracket rigidly secured to said furniture piece and having a mounting means adapted to engage said bracket second mounting means to removably mount said support bracket to said hanger bracket; and a hanger clip actuating means connected to said support bracket and adapted to engage said hanger clip to force said hanger clip into the locked position when said support bracket is mounted to said hanger bracket;

whereby said hanger clip is automatically set in locked position when said support bracket is mounted to said hanger bracket.

12. A mounting assembly according to claim 11, wherein said first mounting means of said hanger bracket comprises at least one hook and at least one tab, said hook and said tab both adapted to removably engage a corresponding number of slots in said standard;

said hanger clip actuating means comprises a rear wall of said support bracket and adapted to force said hanger clip into one of said slots adjacent to either of said hook or said tab to lockably secure said hook and said tab within said slots when said support bracket is mounted to said hanger bracket.

13. A device according to claim 12, wherein said hanger bracket further comprises an aperture having a front edge portion and a rear edge portion; and said hanger clip further comprises a retaining means in registry with said aperture and adapted to engage said front edge portion and said rear edge portion to limit movement of said hanger clip a distance sufficient to enable said hanger clip to move to a fully unlocked position and a fully locked position, respectively.

14. A mounting assembly for removably locking a piece of furniture to a wall, wherein said mounting assembly comprises:

a support means;

means for removably mounting said support means to said wall;

a support bracket rigidly secured to said furniture piece;

mounting means on said support bracket adapted to removably mount said support bracket to said support means;

a support clip movably mounted to said support bracket for horizontal movement between locked and unlocked positions and adapted to engage said support means in the locked position to lockably secure said support bracket to said support means and to prevent inadvertent disengagement of said support bracket from said support means, said support clip being further adapted to be free from engagement with said support means in the unlocked position to allow said support bracket to be freely removed from said support means: and support clip actuating means on said support means adapted to force said support clip from said unlocked position into said locked position when said support bracket is moved horizontally into mounting engagement with said support means;

whereby said support clip is automatically set in locked position when said support bracket is mounted to said support means.

15. A mounting assembly according to claim 14, wherein said mounting means comprises at least one support boss; and said support clip actuating means comprises at least one finger adapted to supportingly engage said support boss and engage said support clip to lockably secure said support boss to said finger when said support bracket is mounted to said support means.

16. A mounting assembly according to claim 15, wherein said support bracket further comprises spaced side walls which define a channel with a slot at a rear edge thereof and in which is positioned said support boss, and a hole extending through one of said side walls; and said finger comprises an upwardly-opening indentation in which said support boss rests when said support bracket is mounted to said support means said finger into a position of engagement with said support boss and in said channel.

17. A mounting assembly according to claim 16 wherein said support clip has a locking flange extending through said hole and into said channel; and said finger is adapted to engage said locking flange to lockably secure said support boss to said finger when said support bracket is mounted to said support means.

18. A mounting assembly according to claim 17, wherein said locking flange is positioned at an acute angle with respect to said side walls.

* * * * *

UNITED STATES PATENT AND TRADEMARK OFFICE

CERTIFICATE OF CORRECTION

PATENT NO. : 4,671,481

DATED : June 9, 1987

INVENTOR(S) : MICHAEL D. BEARD

It is certified that error appears in the above-identified patent and that said Letters Patent are hereby corrected as shown below:

Column 10, lines 58 and 59, the following is deleted:

"said finger into a position of engagement with said support boss and in said channel"

Signed and Sealed this

Twelfth Day of April, 1988

*Attest:*

DONALD J. QUIGG

*Attesting Officer*

*Commissioner of Patents and Trademarks*